United States Patent [19]

Handa

[11] 4,296,937

[45] Oct. 27, 1981

[54] RUBBING-CONTACT SEALING STRUCTURE FOR ROTARY HEAT REGENERATOR

[75] Inventor: Noritoshi Handa, Yokosuka, Japan

[73] Assignee: Nissan Motor Company, Limited, Yokohama, Japan

[21] Appl. No.: 57,291

[22] Filed: Jul. 13, 1979

[30] Foreign Application Priority Data

Jul. 20, 1978 [JP] Japan ..... 53-100631[U]

[51] Int. Cl.[3] ..... F28D 19/04

[52] U.S. Cl. ..... 277/88; 165/9

[58] Field of Search ..... 277/81 R, 88, 89, 90; 165/9

[56] References Cited

U.S. PATENT DOCUMENTS 3,311,162 3/1967 Chapman et al. ..... 165/9

3,773,105 11/1973 Kondo ..... 277/88

FOREIGN PATENT DOCUMENTS 2725140 12/1978 Fed. Rep. of Germany ..... 165/9

*Primary Examiner*—Robert I. Smith

[57] ABSTRACT

A rubbing-contact sealing structure for use in a rotary, counter-flow heat-regenerative heat exchanger having a heat regenerative core rotatable with a housing structure having high-pressure and low-pressure fluid chambers arranged in counter-flow relationship adjacent one face of the core, comprising a main seal element to be in rubbing contact with the particular face of the regenerative core, and a pressing member supported on the housing and in pressing engagement with the main seal element for pressing the main seal element in rubbing contact with the heat regenerative core, the pressing member being substantially flat and parallel with the aforesaid face of the heat regenerative core.

15 Claims, 7 Drawing Figures

RUBBING-CONTACT SEALING STRUCTURE FOR ROTARY HEAT REGENERATOR

FIELD OF THE INVENTION

The present invention relates to a rubbing-contact fluid sealing structure for use with a rotatable heat regenerative core incorporated in, for example, a rotary, counter-flow heat-regenerative heat exchanger for use in, for example, a gas turbine for use, typically, as a prime mover for a land transportation vehicle such as an automotive vehicle.

SUMMARY OF THE INVENTION

In accordance with the present invention, there is provided a rubbing-contact sealing structure for a heat regenerative core rotatable within a stationary housing structure having high-pressure and low-pressure fluid chambers arranged in counter-flow relationship adjacent one face of the heat regenerative core and a high-pressure space surrounding the heat regenerative core and communicating with the high-pressure fluid chamber, comprising a main seal element having an inner end face to be in rubbing contact with the aforesaid face of the heat regenerative core, and an elastic, substantially flat pressing member provided in sealing engagement between the main seal element and the housing structure and at least in part elastically deformable toward and away from the aforesaid face of the heat regenerative core, the pressing member having an outer face at least in part exposed to the aforesaid fluid space and laterally extending substantially in parallel with the aforesaid face of the heat regenerative core in the absence of a differential fluid pressure between both sides of the pressing member, viz., between the low-pressure fluid chamber and the high-pressure fluid space.

BRIEF DESCRIPTION OF THE DRAWINGS

The features and advantages of the sealing structure according to the present invention as compared to prior art sealing structures will be understood more clearly from the following description taken in conjunction with the accompanying drawings in which.

DESCRIPTION OF THE PRIOR ART

Figure 1:
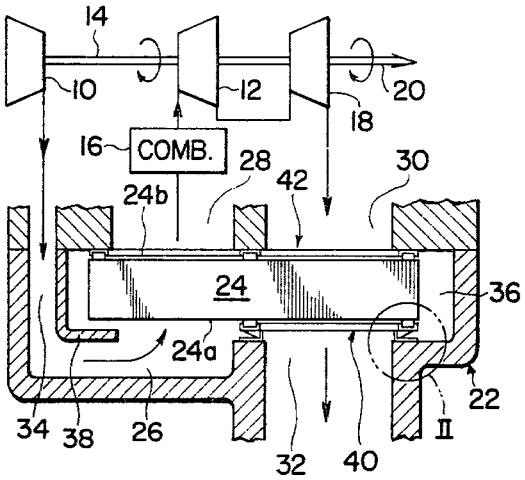
FIG. 1 PRIOR ART
FIG. 1 is a sectional view showing the general arrangement of a prior-art sealing structure provided in a rotary, counter-flow heat-regenerative heat exchanger for a gas turbine which is shown schematically.

Referring first to FIG. 1 of the drawings, a prior-art fluid sealing structure of the type to which the present invention appertains is assumed to be incorporated in a rotary, counter-flow heat-regenerative heat exchanger of a gas turbine to be used as, for example, a prime mover for a land transportation vehicle such as an automotive vehicle. As is well known in the art, a gas turbine of such a nature is usually constructed as a series-flow two-shaft type and generally comprises two sections which are arranged in series with each other. The two sections consist of a gasifier and impeller section and a power section. The gasifier and impeller section comprises an air compressor 10 having a bladed compressor rotor (not shown), a compressor turbine 12 axially positioned in alignment with the air compressor 10 and including a bladed compressor turbine rotor (not shown) connected to the bladed rotor of the compressor 10 by a compressor drive shaft 14, and a combustor 16 including a combustion chamber (not shown) which is arranged to intervene, in effect, between the air compressor 10 and the compressor turbine 12. The combustion chamber forming part of the combuster 16 is usually formed around the compressor rotor and is arranged with a fuel nozzle and an igniter project into the combustion chamber though not shown in the drawings. When the bladed rotor of the air compressor 10 is driven to rotate by the compressor turbine 14 through the compressor drive shaft 14, air sucked into the compressor 10 through an air intake (not shown) of the gas turbine is carried around the compressor rotor and is blown under compression into the combustion chamber of the combustor 16. Into the compressed air thus injected into the combustion chamber of the combustor 16 is sprayed fuel ejected from the fuel nozzle so that a hot combustion gas is produced in the combustion chamber by the combustion of the fuel with the agency of the compressed air. The high-pressure, high-temperature gas thus produced in the combustion chamber of the combustor 16 is directed against the bladed rotor of the compressor turbine 12 and causes the compressor turbine rotor to spin at high speed. The rotation of the compressor turbine rotor is transmitted through the compressor drive shaft 14 to the rotor of the compressor 10 and drives the compressor rotor for rotation with the compressor turbine rotor and the shaft 14, thereby enabling the air compressor 10 to continuously supply fresh compressed air into the combustion chamber of the combustor 16. The igniter forming part of the combustor 16 plays the part of firing the mixture of the fuel and compressed air initially introduced into the combustion chamber but, once such a mixture is fired at an initial stage of a gas turbine operation, the combustion flame produced in the combustion chamber of the combustor 16 continues as long as fuel is thereafter continuously supplied into the combustion chamber. On the other hand, the power section of the gas turbine shown in FIG. 1 is positioned downstream of and axially in alignment with the compressor turbine 12 of the gasifier and impeller section thus arranged generally and comprises a power turbine 18 including a bladed rotor rotatable with a turbine output shaft 20 which is axially in line with the compressor drive shaft 14. The turbine output shaft 20 is secured at one end thereof to the bladed rotor of the power turbine 18 and at the end thereof to a suitable driven member such as, for example, a gear forming part of a power transmission gear assembly (not shown) for an automotive vehicle. The high-pressure, high-temperature gas which has driven the compressor turbine rotor as above described enters the power turbine 18 and causes the bladed rotor of the power turbine 18 to spin about the center axis thereof. The rotation of the power turbine rotor is transmitted through the turbine output shaft 20 to the power transmission gear assembly and is further transmitted, upon reduction of the speed in the transmission gear assembly, to the driving road wheels of the vehicle through, for example, a final drive gear unit (not shown) forming part of the vehicle driveline.

The rotary, counter-flow heat-regenerative heat exchanger provided in the gas turbine engine thus constructed and arranged comprises a generally drum-shaped housing structure 22 having enclosed therewithin a generally disc-shaped heat regenerative core 24 securely mounted on a drive shaft (not shown) for rotation about the center axis of the shaft and having axially outer and inner or cold-side and hot-side faces 24*a* and 24*b* which are perpendicular to the axis rotation of the regenerative core 24. Though not shown in the drawings, the drive shaft for the heat regenerative core 24 is journaled in suitable bearings supported on the housing structure 22 and is usually arranged to be driven by the compressor drive shaft 14 through a suitable reduction gear unit. The heat regenerative core 24 is usually constructed of alternate spiral layers of flat and corrugated sheets of metal or ceramic and, thus, has a multicellular matrix structure formed with a multiplicity of pores or fine passageways (not shown) extending in parallel with the axis of rotation of the core and open at the opposite cold-side and hot-side faces of the core. The heat regenerative core 24 may have a non-porous outer rim defining the outer circumference of the core and a nonporous inner rim constituting a hub by means of which the core is secured to the drive shaft for the core.

The housing structure 22 having the heat regenerative core 24 thus accommodated therewithin is formed with a cold air inlet chamber 26 contiguous to at least a portion of one semicircular half of the cold-side face 24*a* of the regenerative core 24, a preheated air outlet chamber 28 contiguous to at least a portion of one semicircular half of the hot-side face 24*b* of the regenerative core 24, a hot exhaust gas inlet chamber 30 contiguous to at least a portion of the other semicircular half of the hot-side face 24*b* of the regenerative core 24, and a cooled exhaust gas outlet chamber 32 contiguous to at least a portion of the other semicircular half of the cold-side face 24*a* of the core 24. The term "semicircular half" of the cold-side or hot-side face 24*a* or 24*b* as above mentioned does not necessarily mean that such an area of the cold-side or hot-side face of the heat regenerative core 24 has a geometrically exact semicircular configuration but may imply any of acute-angle or obtuse-angle sector-shaped configurations largely similar to a semicircular configuration. The cold air inlet chamber 26 and the preheated air outlet chamber 28 are substantially coextensive in cross section with each other across the heat regenerative core 24 and, likewise, the hot exhaust gas inlet chamber 30 and the cooled exhaust outlet chamber 32 are substantially coextensive in cross section with each other across the the regenerative core 24, as will be seen from FIG. 1. The cold air inlet chamber 26 is in constant communication with the discharge end of the air compressor 10 through a compressed air conducting passageway 34 so that the compressed air delivered from the air compressor 10 is constantly directed through the passageway 34 into the cold air inlet chamber 26 and is passed to the preheated air outlet chamber 28 through the pores or passageways in the regenerative core 24. The preheated air outlet chamber 28 is in constant communication with the combustion chamber of the combustor 16 through a suitable air passageway formed in part in the housing structure 22. The air inlet and outlet chambers 26 and 28 longitudinally aligned with each other across one semicylindrical half of the heat regenerative core 24 thus constitute passageway means defining an incoming fluid a path for the unidirectional stream of the compressed air to be passed through the heat regenerative core 24 in one direction parallel with the axis of rotation of the core 24. On the other hand, the hot exhaust gas inlet chamber 30 of the heat exchamger is in constant communication with the discharge end of the power turbine 18 through a suitable passageway (not shown) formed in part in the housing structure 22 so that the high-temperature, high-pressure exhaust gases which have been discharged from the power turbine 18 are constantly directed into the hot exhaust gas inlet chamber 30 and are passed to the cooled exhaust gas outlet chamber 32 through the pores or passageways in the heat regenerative core 24. The cooled exhaust gas outlet chamber 32 is open to the outside of the gas turbine or, usually, to the atmosphere through a suitable exhaust gas discharge passageway (not shown). The air inlet and outlet chambers 30 and 32 longitudinally aligned with each other across the other semicylindrical half of the heat regenerative core 24 thus constitute passageway means defining an outgoing fluid path for the unidirectional stream of the exhaust gases to be passed through the heat regenerative core 24 in the other direction parallel with the axis of rotation of the core 24. The paths of the incoming and outgoing fluids to be passed through the heat regenerative core 24 are thus in counterflow relationship to each other. The housing structure 22 is further formed with an annular space 36 surrounding the outer peripheral surface of the heat regenerative core 24 and formed in part by a partition member 38 secured to or forming part of the housing structure 22. The annular space 36 is open to the cold air inlet chamber 26 or otherwise in constant communication with the discharge end of the air compressor 10 so that the compressed air delivered from the air compressor 18 is in part passed through the chambers 26 and 28 to the combustion chamber of the combustor 18 and in part admitted into the annular space 36 for the reason that will be explained later.

Throughout operation of the gas turbine, the heat regenerative core 24 of the heat exchanger above described is continuously driven to rotate about the axis of rotation thereof. Thus, portions of the heat regenerative core 24 alternately traverse the incoming fluid path between the air inlet and outlet chambers 26 and 28 and the outgoing fluid path between the exhaust inlet and outlet chambers 30 and 32 and are thereby alternately heated by the hot exhaust gases passed from the chamber 30 to the chamber 32 and cooled by the fresh, compressed air passed from the chamber 26 to the chamber 28. The heat in the hot exhaust gases being passed from the hot exhaust gas inlet chamber 30 to the cooled exhaust gas outlet chamber 32 is therefore partially transferred to a portion of the rotating heat regenerative core 24 and is thereafter further transferred through the portion of the core to the fresh, compressed air being passed from the cold air inlet chamber 26 to the preheated air outlet chamber 28 through the portion of the core 24. The useable heat in the exhaust gases to be discharged is in these manners recovered to preheat the compressed air to be fed to the combustor 18.

In order to recover useable heat at a satisfactory efficiency in a heat exchanger of the nature above described, it is important that the counterflow streams of the fluids in the incoming and outgoing fluid paths in the housing structure 22 be hermetically isolated from each other. For this purpose and also to prevent each of the fluids from bypassing the heat regenerative core 24, the heat exchanger in the gas turbine illustrated in FIG. 1 further comprises two rubbing-contact fluid sealing structures 40 and 42 are provided on the cold and hot sides, respectively, of the heat regenerative core 24. The sealing structure 42 provided on the hot side of the heat regenerative core 24 is securely attached to the housing structure 22 and comprises an annular outer strip portion contacting an outer circumferential portion of the hot-side face 24*b* of the heat regenerative core 24 and two radial strip portions (not shown) extending radially inwardly from the annular strip portion and joined together through an annular inner strip portion contacting a center portion of the hot-side face 24*b* of the core 24. The radial strip portions may be arranged in diametrically opposite relationship to each other or may be angled to each other so as to define therebetween two generally sector-shaped open areas one of which has an acute central angle and the other of which has an obtuse central angle about the center axis of the sealing structure 42. The two discrete open areas thus defined by the individual strip portions constituting the hot-side sealing structure 42 are preferably such that are conforming to the respective sectional areas of the preheated air outlet and exhaust gas inlet chambers 28 and 30, respectively, in the housing structure 22.

On the other hand, the rubbing-contact fluid sealing structure 40 provided on the cold side of the heat regenerative core 24 is arranged to be in elastically pressing contact with the cold-side face 24*a* of the heat regenerative core 24 so that a wear to be caused in each of the sealing structures 40 and 42 during use of the heat exchanger can be automatically compensated for by an elastic deformation or displacement of the cold-side sealing structure 40 in the axial direction of the regenerative core 24. In the arrangement shown in FIG. 1, the cold-side sealing structure 40 is assumed, by way of example, to have a generally semicircular or sector-shaped configuration largely conforming to a semicircular or sector-shaped half of the cross sectional configuration of the heat-regenerative core 24 and is located between the cold-side face 24*a* of the regenerative core 24 and the cooled exhaust gas outlet chamber 32.

Figure 2:
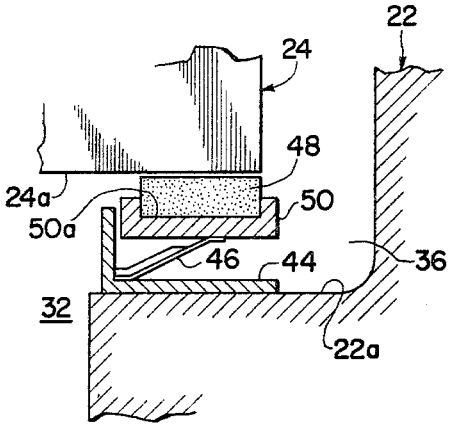
FIG. 2 PRIOR ART
FIG. 2 is a view showing, to an enlarged space, a portion indicated by II in FIG. 1.
Figure 3:
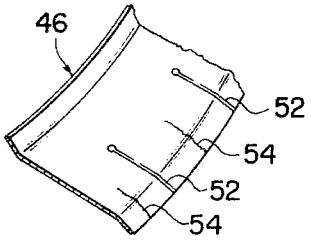
FIG. 3 PRIOR ART
FIG. 3 is a fragmentary perspective view showing, to a further enlarged scale, a portion of the pressing member incorporated in the prior-art sealing structure illustrated in FIGS. 1 and 2.

As illustrated to an enlarged scale in FIG. 2, the cold-side sealing structure 40 comprises a generally sector-shaped support member 44 consisting of a flat base wall portion spaced apart in parallel from the cold-side face 24*a* of the heat regenerative core 24 and securely attached to a correspondingly shaped internal surface portion 22*a* of the housing structure 22 and an inner side wall portion perpendicularly upstanding from the base wall portion toward the cold-side face 24*a* of the regenerative core 24. A generally sector-shaped pressing member 46 constituted by a Belleville (initially coned or dished) spring is securely attached along its inner peripheral end to the flat base wall portion of the support member 44 and has an outer peripheral end portion spaced apart from and extending over the base wall portion of the support member 44 as shown. Between the pressing member 46 thus arranged and the cold-side face 24*a* of the heat regenerative core 24 is positioned a combination of a generally sector-shaped seal element 48 and a generally sector-shaped seal retaining member 50 formed with a continuous groove 50*a* having the seal element 48 closely received therein. The seal retaining member 50 has a flat outer face contacted by the outer peripheral end portion of the pressing member 46 and an inner peripheral surface contacted by or slightly spaced apart from the outer peripheral surface of the inner side wall portion of the support member 44. The seal element 48 axially protrudes from the groove 50*a* in the seal retaining member 50 and is slidably contacted by the cold-side face 24*a* of the heat regenerative core 24 by the spring force of the pressing member 46 which elastically presses the combination of the seal retaining member 50 and the seal element 48 toward the cold-side face 24*a* of the heat regenerative core 24. As illustrated to a further enlarged scale in FIG. 3, the pressing member 46 is formed with a series of slits 52 which are arranged at suitable regular intervals along the pressing member and which extend perpendicularly to and termenate at the outer peripheral end of the pressing member so that the pressing member functions effectively as a Belleville spring. In a modified version of the sealing structure, the pressing member 46 is secured along its outer peripheral end to the flat outer face of the seal retaining member 50 and has its inner peripheral end portion held in pressing contact with the inner surface of the base wall portion of the support member 44.

When the gas turbine is in operation, the seal element 48 forming part of the cold-side sealing structure 40 thus constructed and arranged is held in rubbing contact with the cold-side face 24*a* of the rotating heat regenerative core 24 so that the exhaust gases which have left the heat regenerative core 24 are confined in the outgoing fluid path thereof and are thereby precluded from being admixed to the fresh air flowing through the cold air inlet chamber 26 into the heat regenerative core 24. Throughout operation of the gas turbine, a differential pressure is established across the cold-side sealing structure 40 by the high-pressure air in the annular space 36 surrounding the heat regenerative core 24 and the low-pressure exhaust gases in the cooled exhaust gas outlet chamber 32. The differential pressure acts on the flat outer face of the seal retaining member 50 of the sealing structure 40 partially through the slits 52 in the pressing member 46 and, in cooperation with the pressing member 46, presses the seal element 48 against the cold-side face 24*a* of the heat regenerative core 24 for enhancing the sealing effect between the seal element 48 and the regenerative core 24.

When the seal element 48 is in rubbing contact with the cold-side face 24*a* of the heat regenerative core 24, the pressing member 46 thus pressing the seal element 48 against the cold-side face 24*a* of the regenerative core 24 is forced to expand outwardly with its slits 52 wider open. This not only results in leakage of the high-pressure air from the cold air inlet chamber 26 and the annular space 36 into the cooled exhaust gas outlet chamber 32 through the enlarged slits 52 in the pressing member 46 but is sometimes causative of cracks in an outer peripheral portion of the pressing member as indicated at 54 in FIG. 3 due to the production of unusual and localized stresses in the regions of the slits 52. The present invention aims at provision of an improved rubbing-contact fluid sealing structure free from these disadvantages.

DESCRIPTION OF PREFERRED EMBODIMENTS

FIGS. 4 to 7 show some preferred embodiments of the present invention to achieve such an end. In each of these embodiments of the present invention, the sealing structure is assumed to be incorporated into a rotary, counter-flow heat-regenerative heat exchanger similar to that shown in FIG. 1 and is, thus, shown to be provided in conjunction with a rotatable heat regenerative core enclosed within a housing structure essentially similar to the housing structure 22 of the heat exchanger illustrated in FIG. 1. In each of FIGS. 4 to 7, therefore, the members, elements and structures similar to those shown in FIG. 1 are designated by the same reference numerals as those denoting such members, elements and structures in FIG. 1 and will be presented in the following description without having recourse to rpeated description of the constructions and functions thereof.

Figure 4:
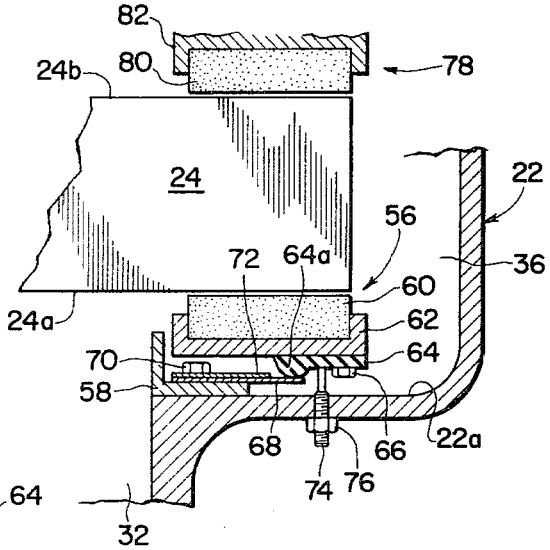
FIG. 4 is a cross sectional view showing a preferred embodiment of the sealing structure according to the present invention.

Referring to FIG. 4 of the drawings, a sealing structure embodying the present invention is shown to be used as a cold-side sealing structure positioned on the downstream side of the outgoing fluid path of the exhaust gases to flow through the heat regenerative core 24 and is designated as a whole by reference numeral 56. The cold-side sealing structure 56 comprises a stationary support member 58 having a generally L-shaped cross section and made up of a flat base wall portion securely sttached to the internal surface portion 22*a* of the housing structure 22 of the heat exchanger and an inner side wall portion projecting from the inner peripheral or lateral end of the base wall portion toward the cold-side face 24*a* of the heat regenerative core 24. A main seal element 60 formed of a ceramic or a suitable ceramic composition and having a rectangular cross section is closely received in part in a shallow groove formed in a seal retaining member 62 having a substantially flat outer face. A resilient auxiliary seal element 64 having a protruded longitudinal edge or rib portion 64*a* and formed of rubber for example is closely attached to the flat outer face of the seal retaining member 62 by suitable fastening means such as a plurality of bolts 66 screwed through a substantially flat portion of the seal element 64 into the seal retaining member 62 so that the rib portion 64*a* extends along the inner peripheral or lateral end of the seal element 64 and protrudes toward the internal surface portion 22*a* of the housing structure 22. The rib portion 64*a* of the auxiliary seal element 64 thus attached to the seal retaining member 62 is spaced apart a suitable distance from the outer surface of the inner side wall portion of the support member 58. A substantially flat pressing member 68 constructed of an elastic sheet metal such as a spring steel is securely attached to the inner surface of the flat base wall portion of the support member 58 by suitable fastening means and extends away from the outer surface of the side wall portion of the support member 58 substantially in parallel with the flat outer face of the seal retaining member 62 and in such a member as to be in contact with the rib portion 64*a* of the auxiliary seal element 64. The fastening means thus securing the pressing member 68 to the support member 58 is shown comprising a plurality of bolts 70 screwed to the flat base wall portion of the support member 58 and a substantially flat clamping member 72 closely interposed between the pressing member 68 and the heads of the bolts 70. The width of the clamping member 72 from the inner peripheral end thereof is such that the clamping member leaves the pressing member 68 uncovered over its area contacting the rib portion 64*a* of the auxiliary seal element 64 as shown. The cold-side sealing structure 56 shown in FIG. 1 further comprises adjusting means adapted to manually adjust the axial position of the rotatable assembly of the main seal element 60, seal retaining member 62 and auxiliary seal element 62 with respect to the housing structure 22 and the heat regenerative core 24. Such adjusting means is shown comprising a plurality of studs 74 which are fitted by means of nuts 76 to the housing structure 22 through tapped holes formed in the housing structure. The studs 74 extend substantially perpendicularly toward the flat outer face of the seal retaining member 62 and about at their respective leading ends against the flat portion of the auxiliary seal element 64 for limiting the displacement of the rotatable assembly of the seal elements 60 and 64 and the seal retaining member 62 away from the cold-side face 24*a* of the heat regenerative core 24.

Each of the support member 58, main seal element 60, seal retaining member 62, auxiliary seal element 64, pressing member 68 and clamping member 72 is assumed to have a generally semicircular sector-shaped configuration and, thus, defines an outgoing fluid path between the cold-side face 24*a* of the heat regenerative core 24 and the cooled exhaust gas outlet chamber 32 formed in the housing structure 22. In FIG. 4 is further shown a hot-side sealing structure 78 comprising a seal element 80 similar in configuration to the seal element 60 of the above described cold-side sealing structure 56 and in contact with the hot-side face 24*b* of the heat regenerative core 24 and a seal retaining member 82 formed with a groove having the seal element 78 in part received therein.

When the gas turbine having the seal structures 56 and 78 incorporated in the heat exchanger thereof is in operation, there is a differential fluid pressure produced by the relatively high pressure of the compressed air in the annular space 36 surrounding the heat regenerative core 24 and the relatively low pressure of the exhaust gases issuing from the heat regenerative core 24 into the cooled exhaust gas outlet chamber 32. The differential fluid pressure acts on both of the auxiliary seal element 64 and the pressing member 68 so that the pressing member 68 is elastically pressed against the rib portion 64*a* of the auxiliary seal element 64, which is as a consequence pressed against the outer face of the seal retaining member 62 by the differential pressure acting thereon and the pressing thus imparted from the pressing member 68 to the seal element 64. The main seal element 60 is therefore feld in pressing and rubbing contact with the cold-side face 24*a* of the rotating heat regenerative core 24 and, accordingly, the heat regenerative core 24 is forced against the seal element 80 of the hot-side sealing structure 78 as long as a differential fluid pressure is maintained between the cooled exhaust gas outlet chamber 32 and the space 36 in the housing structure 22. As abrasion proceeds on the rubbing contact surfaces of the seal elements 60 and 80 of the cold-side and hot-side sealing structures 56 and 78, respectively, the pressing member 68 is caused to wrap toward the cold-side face 24*a* of the heat regenerative core 24 and automatically takes up the wears of the seal elements 60 and 80.

One of the outstanding advantages of the cold-side sealing structure 56 thus constructed and arranged is that the pressing member 68 to maintain the seal between the seal element 60 and the cold-side face 24*a* of the heat regenerative core 24 is constructed of an initially flat sheet metal which is arranged substantially in parallel with the flat outer face of the seal retaining member 62 and which is devoid of slits or slots similar to the slits 52 formed in the pressing member 46 of the previously described prior-art sealing structure. Being thus constructed of an initially flat sheet metal and arranged in parallel with the outer face of the seal retaining member 62, the pressing member 68 functions as an excellent spring when subjected to a fluid pressure on its outer face and is, thus, adapted to achieve proper sealing effected between the seal element 60 and the cold-side face 24*a* of the heat regenerative core 24 and the seal element 80 and the hot-side face 24*b* of the core 24. Being devoid of slits or slots, furthermore, the pressing member 68 is free from leakage of fluid therethrough and from localized stresses which would otherwise lead to production of cracks in the pressing member.

Figure 5:
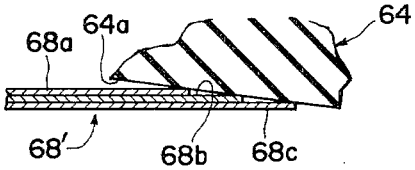
FIG. 5 is a fragmentary cross sectional view showing a modification of the pressing member in the embodiment of FIG. 4.

The pressing member 68 used in the seal structure 56 shown in FIG. 4 is assumed to be constructed of a unitary metal plate but, if desired, such a member may be composed of a laminar structure of two or more leaves or segments of elastic sheet metal. FIG. 5 shows a pressing member 68' consisting of a laminar structure of three metal segments 68*a*, 68*b* and 68*c*. The metal segments 68*a*, 68*b* and 68*c* constituting the pressing member 68' have different widths smaller than each other toward the axially innermost one 68*a* of the segments and have outer peripheral or lateral edges which are arranged in tier. The metal segments 68*a*, 68*b*, 68*c* are secured along their inner peripheral or lateral edges to the support member 58 (FIG. 4) by suitable fastening or clamping means arranged similarly to the bolt 70 and clamping member 72 in the sealing structure 56 shown in FIG. 4 and are successively in contact with the protruded longitudinal edge or rib portion 64*a* of the auxiliary seal element 64 at the respective outer peripheral or lateral edges of the segments. The segments 68*a*, 68*b* and 68*c* may be bonded or otherwise secured together by adhesive or mechanical fastening means or may be simply superposed on each other without being secured together. An advantage of the pressing member 68' thus composed of the different metal segments 68*a*, 68*b* and 68*c* thus arranged is that, since the outer peripheral or lateral edges of the segments are successively in contact with the rib portion 64*a* of the auxiliary seal element 64 at the respective outer peripheral or lateral edges of the segments, an enhanced sealing effect can be achieved between the auxiliary seal element 64 and the pressing member 68'.

Figure 6:
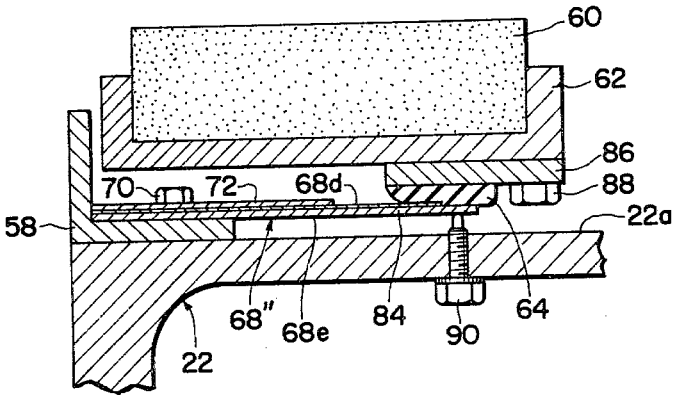
FIG. 6 is a cross sectionsl view showing another preferred embodiment of the sealing structure according to the present invention.

FIG. 6 shows another modification of the cold-side sealing structure 56 illustrated in FIG. 4. In the sealing structure shown in FIG. 6, a pressing member 68'' is composed of a laminar structure of two, axially inner and outer leaves or metal segments 68*d* and 68*e*. The inner metal segment 68*d* is smaller in width and thickness than the outer metal segment 68*e* as shown and the outer metal segment 68*e* is formed with perforations 84 in its outer peripheral or lateral end portion so that a fluid pressure to be developed in the annular space 36 surrounding the sealing structure acts not only on the outer face of the outer metal segment 68*e* but on the outer face of the inner metal segment 68*d* through these perforations 84. The inner and outer metal segments 68*d* and 68*e* are secured along their inner peripheral or lateral ends to the support member 58 by means of the bolt 70 and clamping member 72 as in the sealing structure 56 illustrated in FIG. 4 and are in contact with the resilient auxiliary seal element 64 at the outer peripheral or lateral edges of the segments. The auxiliary seal element 64 in the sealing structure herein shown has a thickness substantially uniform throughout the width thereof and is securely attached to the flat outer face of a base plate 86 which is fastened to the outer face of the seal retaining member 62 by means of bolts 88 screwed through the base plate 86 into the seal retaining member 62. The rotatable assembly thus composed of the main seal element 60, seal retaining member 62, auxiliary seal element 64 and base plate 86 is position adjusted with respect to the housing structure 22 and the heat regenerative core 24 by adjusting means which comprises a plurality of screw threaded members such as bolts 90 fitted to the housing structure 22 through tapped holes in the housing structure and arranged to perpendicularly abut at their respective leading ends against the outer face of the outer metal segment 68*e* of the pressing member 68'. The reason why the inner metal segment 68*d* is made thinner than the outer metal segment 68*e* is to enable the segment 68*d* to properly warp about the outer peripheral or lateral edge of the clamping member 72 when the segment 68*d* is forced to warp toward the outer face of the seal retaining member 62.

Figure 7:
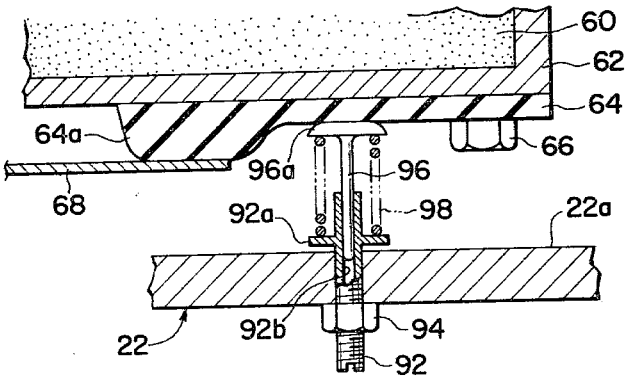
FIG. 7 is a cross sectional view showing part of still another preferred embodiment of the sealing structure according to the present invention.

FIG. 7 shows still another modification of the sealing structure 56 illustrated in FIG. 4. The embodiment herein shown is characterized specifically by adjusting means comprising a plurality of studs 92 each having a bored shank portion formed with an annular flange 92*a* and an axial bore 92*b* which is open at the leading end of the shank portion. Each stud 92 is screwed through a wall portion of the housing structure 22 in such a manner that the flange 92*a* of the shank portion is positioned between the internal surface 22*a* of the housing structure 22 and the auxiliary seal element 64 attached to the flat outer face of the seal retaining member 62 and the axial bore 92*a* in the shank portion is open perpendicularly to the flat portion of the auxiliary seal element 64 as shown. The stud 92 is secured to the housing structure 22 by means of a nut 92. A spring seat element 96 having an elongated rod portion terminating in a disc portion 96*a* has its rod portion axially slidably inserted in part into the axial bore 92*b* in the shank portion of each of these studs 92 so that the disc portion 96*a* of the spring seat element 96 is axially movable between the flat portion of the auxiliary seal element 64 and the inner face of the flange 92*a* of the stud 92. A preloaded helical compression spring 98 is seated at one end on the flange 92*a* of each stud 92 and the disc portion 96*a* of the spring seat element 96 and thus urges the spring seat element 96 to move toward the seal element 64 so that the disc portion 96*a* of the spring seat element 96 is pressed against the outer face of the flat portion of the auxiliary seal element 64. The auxiliary seal element 64 and accordingly the main seal element 60 are therefore constantly forced toward the cold-side face 24*a* of the heat regenerative core 24 (FIG. 4) by the forces of the compression springs 98 respectively provided in association with the individual studs 92 and automatically adjust the pressure by which the heat regenerative core is pressed upon by the main seal element 60. The force of each of the springs 98 can be manually adjusted by turning the stud 92 on the housing structure 22 so as to cause the flange 92*a* of the stud 92 to move toward or away from the disc portion 96*a* of the spring seat element 96 pressed onto the auxiliary seal element 64.

What is claimed is:

1. A rubbing-contact sealing structure for a heat regenerative core rotatable within a stationary housing structure having high-pressure and low-pressure fluid chambers arranged in counter-flow relationship adjacent one face of the heat regenerative core and a high-pressure space surrounding the heat regenerative core and communicating with the high-pressure fluid chamber, comprising: a main seal element having an inner end face to be in rubbing contact with said face of the heat regenerative core, and an elastic pressing member in the form of a substantially flat single plate provided in sealing engagement between said main seal element and said housing structure and at least in part elastically deformable toward and away from said face of the heat regenerative core, the pressing member having an outer face at least in part exposed to said fluid space and laterally extending substantially in parallel with said face of the heat regenerative core in the absence of a differential fluid pressure between the two sides of the pressing member, one end of said pressing member being secured to the housing structure while the other end thereof elastically presses said main seal element against the regenerative core with the aid of the pressure difference between the two sides of said pressing member.

2. A rubbing-contact sealing structure as set forth in claim 1, further comprising a resilient auxiliary sealing element connected to the main seal element in a position between said main seal element and said pressing member so that said pressing member is held in elastically pressing contact with the outer face of said auxiliary seal element.

3. A rubbing-contact sealing structure as set forth in claim 2, in which said auxiliary seal element has a rib portion protruding away from said face of the heat regenerative core, said pressing member being in elastically pressing contact with said rib portion of the auxiliary seal element.

4. A rubbing-contact sealing structure as set forth in claim 2, in which said pressing member consists of a laminar structure of a plurality of segments each of elastic sheet metal, said segments being closely superposed on each other and having longitudinal edges arranged in tier and successively in contact with said auxiliary seal element.

5. A rubbing-contact sealing structure as set forth in claim 4, in which the outermost one of said segments is at least in part exposed to said fluid space and is formed with perforations distributed over its area contacting the adjacent one of the segments.

6. A rubbing-contact sealing structure as set forth in claim 4, in which said segments include inner and outer segments which are superposed on each other and which are respectively closer to and remoter from said main seal element, the inner segment being thinner than the outer segment.

7. A rubbing-contact sealing structure as set forth in claim 2, in which said pressing member is secured along one lateral end thereof to said housing structure by means of a plurality of bolts screwed through the pressing member with a clamping member closely interposed between the pressing member and the heads of the bolts.

8. A rubbing-contact sealing structure as set forth in claim 2, further comprising adjusting means fitted to said housing structure and held in pressing engagement with said auxiliary seal element for limiting the displacement of said main seal element away from said face of said heat regenerative core.

9. A rubbing-contact sealing structure as set forth in claim 8, in which said adjusting means comprises a screw threaded member adjustably fitted to said housing structure and axially extending toward said face of said heat regenerative core for abutting engagement at one axial end thereof against the outer face of said auxiliary seal element.

10. A rubbing-contact sealing structure as set forth in claim 8, in which said adjusting means comprises a screw threaded member adjustably fitted to said housing structure and axially extending toward said face of said heat regenerative core for abutting engagement at one axial end thereof against the outer face of said pressing member.

11. A rubbing-contact sealing structure as set forth in claim 8, in which said adjusting means comprises a screw threaded member adjustably fitted to said housing structure and axially extending toward said face of said heat regenerative core, the screw threaded member having a flange positioned at a spacing from the outer face of said auxiliary seal element and an axial bore open toward the outer face of the auxiliary seal element, a spring seat element having rod portion in part axially slidably received in said axial bore and a disc portion axially spaced apart from said flange toward the outer face of the auxiliary seal element, and a biasing element seated between said flange and said disc portion for urging the disc portion to be spaced wider apart from the flange and to be pressed against the outer face of the auxiliary seal element.

12. A rubbing-contact sealing structure for a heat regenerative core rotatable within a stationary housing structure having high-pressure and low-pressure fluid chambers arranged in counter-flow relationship adjacent one face of the heat regenerative core and a high-pressure space surrounding the heat regenerative core and communicating with the high-pressure fluid chamber, comprising: a main seal element having an inner end face to be in rubbing contact with said face of the heat regenerative core, and an elastic, substantially flat pressing member provided in sealing engagement between said main seal element and said housing structure and at least in part elastically deformable toward and away from said face of the heat regenerative core, the pressing member having an outer face at least in part exposed to said fluid space and laterally extending substantially in parallel with said face of the heat regenerative core in the absence of a differential fluid pressure between both sides of the pressing member, a resilient auxiliary sealing element fastened on the main seal element and having an outer face at least in part exposed to said fluid space, said pressing member being secured at one end thereof to said housing structure and held in elastically pressing contact at the other end thereof with the outer face of said auxiliary seal element, and adjusting means fitted to said housing structure and held in pressing engagement with said auxiliary seal element for limiting the displacement of said main seal element away from said face of said heat regenerative core.

13. A rubbing-contact sealing structure as set forth in claim 12, in which said adjusting means comprises a screw threaded member adjustably fitted to said housing structure and axially extending toward said face of said heat regenerative core for abutting engagement at one axial end thereof against the outer face of said auxiliary seal element.

14. A rubbing-contact sealing structure as set forth in claim 12, in which said adjusting means comprises a screw threaded member adjustably fitted to said housing structure and axially extending toward said face of said heat regenerative core for abutting engagement at one axial end thereof against the outer face of said pressing member.

15. A rubbing-contact sealing structure as set forth in claim 12, in which said adjusting means comprises a screw threaded member adjustably fitted to said housing structure and axially extending toward said face of said heat regenerative core, the screw threaded member having a flange positioned at a spacing from the outer face of said auxiliary seal element and an axial bore open toward the outer face of the auxiliary seal element, a spring seat element having a rod portion in part axially slidably received in said axial bore and a disc portion axially spaced apart from said flange toward the outer face of the auxiliary seal element, and a biasing element seated between said flange and said disc portion for urging the disc portion to be spaced wider apart from the flange and to be pressed against the outer face of the auxiliary seal element.

* * * * *